United States Patent [19]

Blanchard

[11] 3,955,540

[45] May 11, 1976

[54] ROTARY INTERNAL COMBUSTION ENGINE

[76] Inventor: James G. Blanchard, 3500 E. Texas St., Lot 17, Bossier City, La. 71010

[22] Filed: May 22, 1974

[21] Appl. No.: 472,500

[52] U.S. Cl. ..... 123/8.45; 418/136; 418/256

[51] Int. Cl.[2] ..... F02B 55/14

[58] Field of Search ..... 123/8.45; 418/259, 256, 418/260, 136

[56] References Cited

UNITED STATES PATENTS

| | | | |
|---|---|---|---|
| 586,497 | 7/1897 | Isbell | 418/260 |
| 771,593 | 10/1904 | Welsh | 418/259 |
| 1,042,596 | 10/1912 | Pearson | 418/264 |
| 2,215,232 | 9/1940 | Reed | 123/8.45 |
| 2,463,155 | 3/1949 | Dawes | 418/259 |
| 3,464,395 | 9/1969 | Kelly | 123/8.45 |

*Primary Examiner*—William L. Freeh
*Assistant Examiner*—O. T. Sessions
*Attorney, Agent, or Firm*—John M. Harrison

[57] ABSTRACT

A rotary internal combustion engine which includes a housing having a cylindrical inner peripheral wall surface, a hollow, cylindrical rotor rotatably shaft-mounted in the housing in eccentric relationship with respect to the housing, a cylindrical vane track positioned in the hollow cavity of the rotor and located in the center of the housing, and vanes slidably and radially disposed in the walls of the rotor and adapted to traverse the vane track and inner peripheral wall surface of the housing as the rotor rotates. The rotor and vanes cooperate with the housing to define a plurality of chambers which become successively smaller as they are charged with fuel and approach the firing area of the housing, and larger after combustion as they approach the exhaust and intake segments of the housing.

1 Claim, 3 Drawing Figures

ROTARY INTERNAL COMBUSTION ENGINE

BACKGROUND OF THE INVENTION

1. Field of the Invention

This invention relates to a new and improved internal combustion engine, and more specifically, to an internal combustion engine of rotary design. The engine eliminates most of the moving parts of the conventional reciprocating engines such as cylinders, pistons, connecting rods, crankshaft, timing gears or chains, camshaft, push rods, rocker arms, valves, and valve springs, and the like. In a preferred embodiment, the rotary engine of this invention is designed to deliver four power impulses per revolution, each of which drives the rotors one-fourth of one revolution, and is built to provide a favorable horsepower-per-weight ratio with a displacement which is smaller than conventional engines presently in commercial use.

2. Description of the Prior Art

Typical of the prior art regarding rotary internal combustion engines is U.S. Pat. No. 3,727,589 to Wilbert M. Scott, which patent discloses a rotary engine with an oval inner wall surface and a rotor equipped with radially sliding vanes which operate on cam tracks. A predominant difficulty with an engine of this design is the problem of effecting proper sealing of the vanes as they traverse the cam tracks and also effecting proper lubrication of the engine parts.

Accordingly, an object of this invention is to provide an improved internal combustion engine and particularly, an improved engine of the rotary type, which may be effectively cooled and sealed against high pressure and is, therefore, more efficient than predecessor designs.

Another object of the invention is to provide an internal combustion engine which has no conventional cylinders, pistons, connecting rods, crankshaft, timing gears or chain, camshaft, push rods, rocker arms, valves or valve springs.

Yet another object of the invention is to provide a novel rotary internal combustion engine which can be fitted with conventional engine service items such as a water pump, oil pan, carburetor or fuel injection device, intake and exhaust manifolds, oil pump, and the like, with minimum or no service item design alterations.

Still another object of the invention is to provide a rotary internal combustion engine which can be designed to utilize substantially any number of spark plugs or alternative fuel ignition means.

Yet another object of the invention is to provide an internal combustion engine of the rotary type which has a minimum number of moving parts and which is therefore essentially maintenance free.

Still another object of this invention is the provision of a rotary engine which can be quickly and easily disassembled by removing two end plates, repaired, and reassembled when maintenance is needed.

A further object of the invention is to provide a rotary internal combustion engine which can be adapted to operate on a variety of fuels such as gasoline, bottled gas or other fuel suited for conventional engines.

A still further object of this invention is to provide a rotary internal combustion engine which is characterized by a longer engine life and less maintenance than conventional engines due to the presence of fewer moving parts and corresponding reduction of friction.

Yet another object of the invention is to provide a rotary engine, the displacement of which is far smaller, and the friction of which is reduced to a small fraction of that present in conventional cylinder-type reciprocating internal combustion engines and rotary engines.

Still another object of the invention is to provide an engine which is characterized by a greatly increased horsepower-to-weight ratio as compared to conventional engines.

Yet another object of the invention is to provide an internal combustion engine of the rotary design which is physically small in size, and yet which will develop horsepower levels comparable to conventional engines.

A still further object of the invention is to provide a rotary internal combustion engine having an essentially cylindrical housing and an essentially cylindrically shaped rotor positioned in eccentric relationship within the housing to provide the capability for compressing, igniting and expanding fuel.

SUMMARY OF THE INVENTION

These and other objects of the invention are provided in a rotary internal combustion engine which, in a preferred embodiment, includes the following:

1. A housing fitted with at least one spark plug, intake and exhaust ports, and having a substantially cylindrical inner peripheral wall surface fitted with intake and exhaust ports;

2. A cylindrical rotor having a cavity partially through the center thereof, mounted on a shaft within the housing, the rotor being mounted in eccentric relationship with respect to the housing, with the rotating outer peripheral rotor wall clearing the inner peripheral wall of the housing at the closest point near the spark plug;

3. A cylindrical vane race positioned in nonrotatable relationship within the hollow cavity of the rotor and in the center of the housing, but in eccentric relationship with respect to the hollow cavity of the rotor; and 4. Vanes slidably disposed in the walls of the rotor and adapted to traverse the vane race and inner peripheral wall surface of the housing as the rotor rotates, defining a plurality of chambers which become successively smaller as they become charged with fuel from the intake port and approach the spark plug, and successively larger as they approach the exhaust and intake ports mounted in the housing.

BRIEF DESCRIPTION OF THE DRAWINGS

The invention will be better understood in view of the following description presented with reference to the accompanying drawings.

DESCRIPTION OF THE PREFERRED EMBODIMENTS

Figure 1:
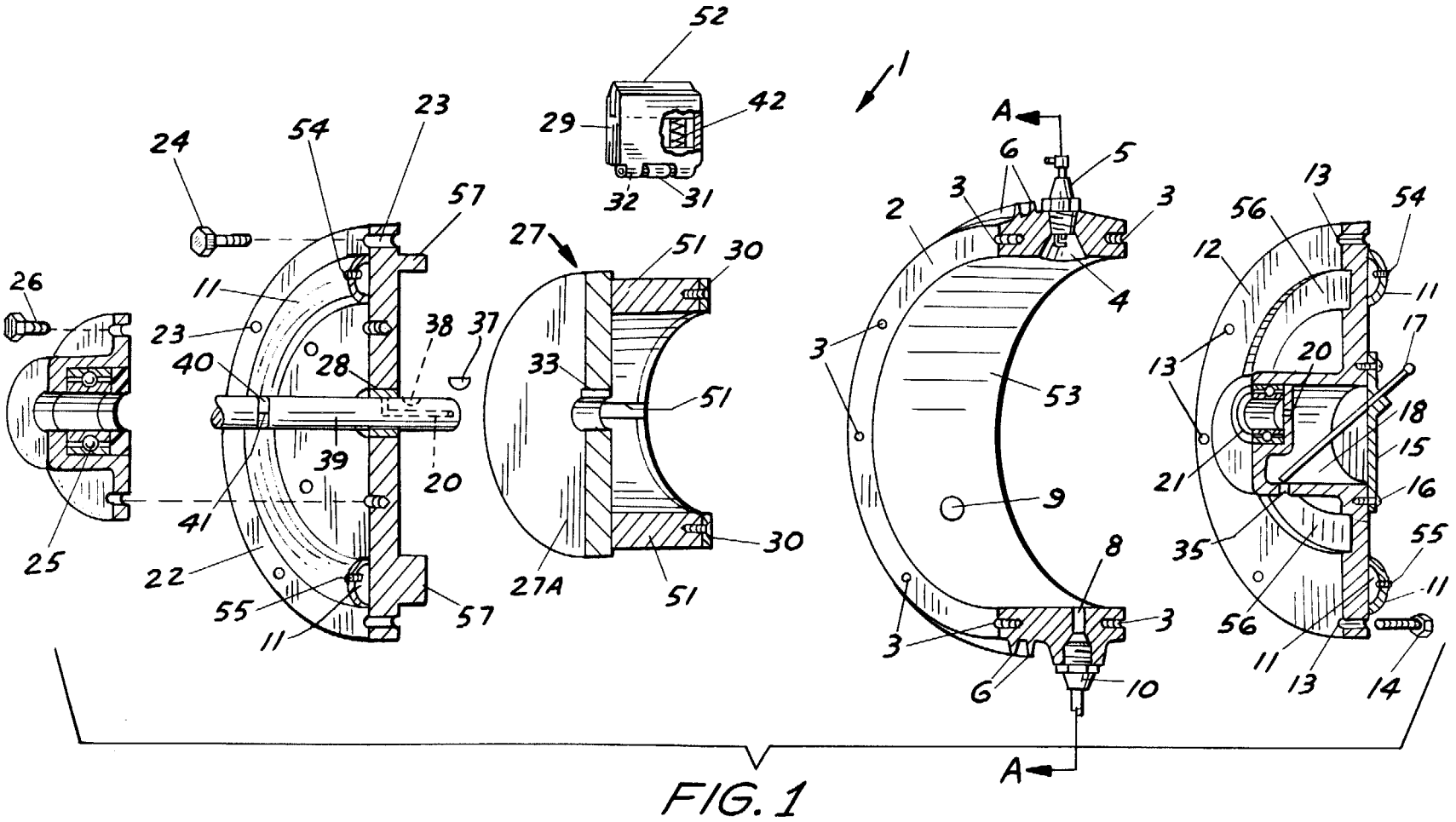
FIG. 1 of the drawings is a perspective, exploded view, partially in section, of the rotary internal combustion engine of this invention.

Referring now to FIG. 1 of the drawing, the rotary engine of this invention, generally illustrated by reference numeral 1, is shown in exploded view, partially in section. Housing 2, fitted with threaded housing apertures 3, is equipped with spark plug 5, intake port 8, and exhaust port 9. Combustion chamber 4 is provided in housing 2 immediately below spark plug 5, and fuel jet 10 is removably fitted into the housing adjacent intake port 8.

Rear end plate 12, fitted with water jacket 11, rear end plate holes 13, and vane race 35, is bolted onto and closes the rear of housing 2 by means of rear end plate bolts 14. Vane race 35 is in turn fitted with rear end plate bearing 21, oil reservoir 18, and dip stick plate 15, the latter of which is mounted on rear end plate 12 by means of dip stick plate bolts 16. Dip stick 17 is adapted to extend into oil reservoir 18 in order to read the oil level therein. Oil duct 20 in oil reservoir 18 effects lubrication of rear end plate bearing 21 from oil supply 19 (illustrated in FIG. 3).

Forward end plate 22, also fitted with a water jacket 11, forward end plate holes 23, forward end plate bearing 25, and bushing 28, is bolted onto housing 2 by means of forward end plate bolts 24. Forward end plate bearing 25 is bolted onto forward end plate 22 by means of forward end plate bearing bolts 26. Shaft 39 is rotatably carried by forward end plate bearing 25, and is fitted with key slot 38 and timing collar 40, the latter of which is equipped with timing collar lobes 41. Shaft 39 is also provided with an oil duct 20 for lubricating forward end plate bearing 25.

Rotor 27 is removably fitted onto shaft 39 by means of rotor drive key 37 in cooperation with key slot 38 provided in shaft 39 and rotor key slot 33 in rotor cap plate 27A.

Figure 2:
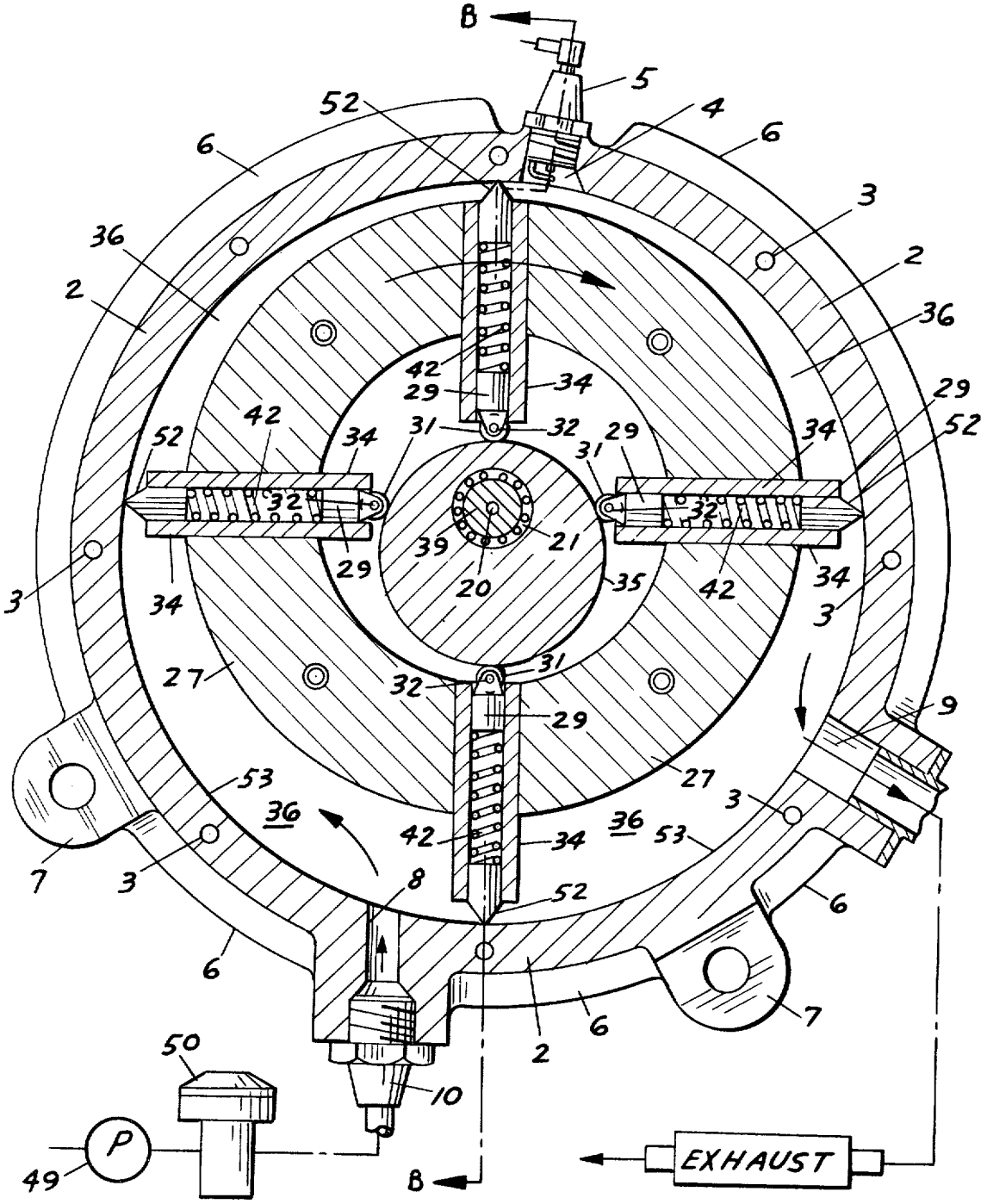
FIG. 2 is a sectional view along axis A—A of the engine illustrated in FIG. 1.

Referring now to FIGS. 1 and 2 of the drawings, rotor 27, carrying rotor cap plate 27A, is rotatably positioned between forward end plate 22 and rear end plate 12 inside housing 2, by means of vanes 29 located at selected points in vane slots 51, radially positioned in the periphery of rotor 27. Vane oil seals 34 are mounted adjacent vane slots 51, and vanes 29 are designed to traverse housing inside wall 53 and vane race 35 by means of cooperating vane tips 52 and vane rollers 31, respectively, as the rotor is caused to rotate. Vane rollers 31 are preferably carried by vane roller shafts 32 mounted in vanes 29. Vane springs 42 serve to seat vane tips 52 firmly in place on housing inside wall 53 and vane race 35, and vane oil seals 34 provide lateral compression sealing as the engine operates. It will be appreciated that while it is preferred to use spring biasing of vanes 29 and vane oil seals 34, alternative biasing means known to those skilled in the art may also be used as deemed expedient.

Figures 3, 4:
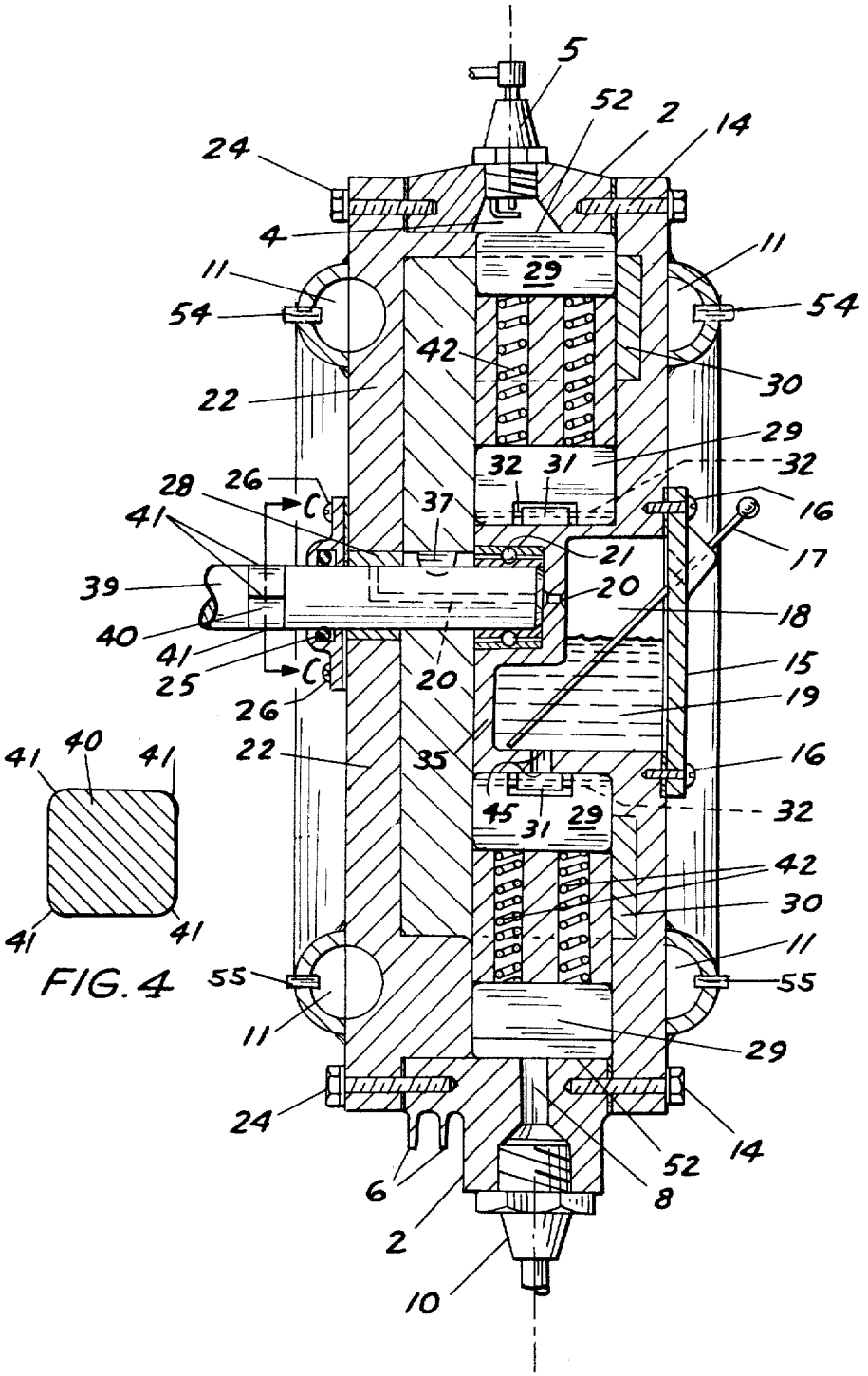
FIG. 3 is a sectional view along axis B—B of the engine illustrated in FIG. 2.
FIG. 4 is a sectional view along axis C—C of the engine illustrated in FIG. 3, of the timing collar and shaft of the engine illustrated in FIGS. 1–3, more particularly illustrating the timing collar points utilized to initiate firing of the engine in a preferred aspect of the invention.

Referring now to FIGS. 2 and 3 of the drawings, it will be apparent that rear end plate bearing 21 is located in eccentric relationship with respect to the center of vane race 35, and forward end plate bearing 25 and bushing 28 are likewise located off-center in forward end plate 22, to match rear end plate bearing 21. Accordingly, shaft 39 is also eccentrically positioned with respect to the center axis of cylindrically shaped engine housing 2, and rotor 27, affixed to shaft 39 by means of rotor cap plate 27a and rotor drive key 37, is constrained to rotate on shaft 39 eccentrically around vane race 35. Likewise, as rotor 27 is caused to rotate, vanes 29 carried therein are constrained to traverse vane race 35 and housing inside wall 53 of housing 2, and create fuel chambers 36 formed between the respective vanes 29.

In a preferred embodiment of the invention, four vanes are utilized in the engine, as illustrated in the drawings. However, depending upon design requirements, substantially any number of vanes may be used as desired, to create an optimum number of fuel chambers for given engine design requirements. Furthermore, referring again to FIG. 2 of the drawing, conventional fuel pump 49, and carburetor 50 (or fuel injection, if desired) can be utilized, and a conventional timing system may also be employed, with a timing collar 40 having timing collar lobes 41, as illustrated in FIG. 4 of the drawing. Furthermore, optional cooling fins 6 may be either formed integrally with or affixed to the exterior of housing 2, which housing may be in turn mounted onto a vehicle frame by means of mounting brackets 7.

Spark plug 5 is conventionally designed for removable insertion in housing 2, as illustrated in the drawings, and communicates with combustion chamber 4 to facilitate firing of fuel in fuel chambers 36, identified above. It will be appreciated that alternative firing techniques such as that used in diesel engine operation may also be utilized as is considered expedient by those skilled in the art.

Tracing a typical engine firing sequence, the respective intake, compression, combustion and exhaust strokes are achieved as follows, with particular reference to FIG. 2 of the drawing: As the starter motor (not illustrated) is activated, rotor 27 is caused to rotate in a clockwise direction as indicated by the arrow, and fuelair mixture effected by fuel pump 49 and carburetor 50 is injected into the engine via fuel jet 10, through intake port 8. The charge is confined in an initially comparatively large fuel chamber 36, defined by two vanes as described above, and as illustrated. As rotor 2 continues to rotate, the initial fuel chamber 36 becomes progressively smaller due to the eccentric mounting of rotor 27 with respect to housing 2 and vane race 35, and the mixture is compressed. When the mixture reaches optimum compression at spark plug 5 and combustion chamber 4, spark plug 5 is caused to fire, thereby igniting the fuel, forcing rotor 7 in a clockwise direction indicated by the arrow, and effecting an expansion of the spent gases in fuel chamber 36 due to the eccentric arrangement among housing 2, rotor 27 and vane race 35. As the rotor continues to turn and the gases expand, the spent fuel is forced out of exhaust port 9 in the final step of the firing sequence. It will be appreciated that as the first fuel chamber 36 receives an initial charge of fuel and air and is compressed, the next succeeding fuel chamber 36 receives a second charge, and so on, to facilitate continued operation of the engine.

It will be appreciated that fuel chambers 36 are kept well sealed from each other and other sections of the engine by action of vane tips 52, vane oil seals 34 and rotor gasket 30, the latter of which is positioned on the rear circumferential surface of rotor 27. Vane tips 52 are maintained in close contact with housing inside wall 53 by the cooperating action of vane springs 42, vane rollers 31 and vane race 35. Vane springs 42 serve to maintain a tight seal against housing inside wall 53 despite wear in vane tips 52, because of constant spring tension against vane tips 52 and vane rollers 31. Roller seal slot 56 in rear end plate 12 is adapted to mate with rotor gasket 30, to aid in rear sealing of fuel chambers 36. Rotor cap plate 27A is also designed to mate with a cylindrical depression in forward end plate 22, which depression is defined by forward end plate lip 57, to effect forward sealing of chambers 36.

It will be further appreciated that while the rotary engine of this invention is preferably characterized by a single spark plug and four vane arrangement, the engine may be fitted with multiple spark plugs and vanes, and as few as three vanes, as desired. Similarly, the spark plugs may be arranged in opposed fashion, and the intake and exhaust ports located as considered expedient by those skilled in the art to accommodate such a design.

As heretofore noted, conventional accessory items such as radiator, carburetor, oil pump, water pump, starter, timing system, and the like, can be made compatible with the engine of this invention with a minimum of design changes in such equipment. For example, referring again to FIG. 3 of the drawing, a conventional oil pump may be made compatible with the oil reservoir 18 of the instant engine to clean the oil 19 in the reservoir. It will be appreciated that oil 19 is supplied to forward end plate bearing 25 and rear end plate bearing 21 via oil ducts 20, as heretofore noted, for proper bearing lubrication. Other oil supply ducts may be provided as deemed necessary to critical areas of the engine; for example, vane oil ducts 45 communicating with vane rollers 31 to lubricate vane race 35 and vane rollers 31 may be provided as deemed necessary by those skilled in the art.

For ease of maintenance, it will be appreciated that forward end plate bearing 25 is preferably bolted in place by means of forward end plate bolts 26, as heretofore noted, and easy access to oil reservoir 18 is provided by means of dip stick plate 15 and dip stick plate bolts 16. Access to the interior of the engine is achieved by removal of rear end plate bolts 14 and forward end plate bolts 24. The engine may be air or water cooled, and in the latter case, water is caused to flow through water jackets 11 via water jacket inlets 54 and outlets 55. In the air or water cooled design, cooling fins 6 may be utilized to aid in dissipating heat, as desired.

Having described my invention with the particularity set forth above, what is claimed is:

1. A rotary internal combustion engine comprising:

a. a housing fitted with at least one fuel ignition means, an intake port, an exhaust port, and a cylindrically shaped housing inside wall of uniform diameter;

b. a forward end plate fitted with an external water jacket, a bushing, carrying a forward end plate lip, and removably mounted on the forward end of said housing, and a rear end plate fitted with an external water jacket and a concentric groove, and mounted on the rear end of said housing to close said housing;

c. a cylindrically shaped rotor positioned in eccentric rotational relationship inside said housing, said rotor having a cylindrically shaped cavity and a plurality of slots radially disposed therein, said slots communicating from the outer periphery of said rotor to said cavity, the rear circumferential edge of said rotor being in registration with said concentric groove in said rear end plate;

d. a rotor cap plate carried by said rotor closing one end of said rotor and cooperating with said forward end plate and said forward end plate lip to seal said forward end plate;

e. a cylindrically shaped vane race housing an oil reservoir and carried by said rear end plate and positioned in eccentric registration with said cylindrically shaped cavity in said rotor;

f. a plurality of vanes each having a slot at the top thereof and a pair of cavities therein and slidably disposed in said slots, and adapted to traverse said vane race and said housing inside wall when said rotor is caused to rotate within said housing, said vanes, said forward end plate, said rear end plate, said rotor, and said housing inside wall defining a plurality of fuel chambers in said engine;

g. a shaft carried by said rotor cap plate and journaled for rotation in said bushing in said forward end plate and said rear and plate;

h. a vane tip slidably disposed in said top of each of said vanes and adapted to traverse said housing inside wall;

i. vane springs in each of said cavities of said vanes to bias said vane tips against said housing inside wall;

j. vane rollers rotatably mounted on said vanes and traversing said vane race when said rotor is caused to rotate; and k. a rear end plate bearing disposed in the upper center of said vane race and rotatably carrying one end of said shaft and a forward end plate bearing mounted on the outside surface of said forward end plate in alignment with said rear end plate bearing to rotatably seat the opposite end of said shaft.

* * * * *